US005957009A

United States Patent [19]

McCann

[11] Patent Number: 5,957,009

[45] Date of Patent: Sep. 28, 1999

[54] CONTROL MECHANISM FOR RATCHET WRENCH

[76] Inventor: Frank McCann, 121, Yung Ho Road, Ta Ya Hsiang, Taichung Hsien, Taiwan

[21] Appl. No.: 08/951,355

[22] Filed: Oct. 16, 1997

[51] Int. Cl.[6] ..... B25B 13/46

[52] U.S. Cl. ..... 81/63.2; 81/63; 192/43

[58] Field of Search ..... 81/63, 63.1, 63.2; 192/43

[56] References Cited

U.S. PATENT DOCUMENTS

| | | | |
|---|---|---|---|
| 3,019,682 | 2/1962 | Hare | 81/63.2 |
| 3,369,416 | 2/1968 | Kilness | 81/63.2 X |
| 4,328,720 | 5/1982 | Shiel | 81/63 |
| 4,762,033 | 8/1988 | Chow | 81/63.2 |
| 5,533,427 | 7/1996 | Chow | 81/63.2 |
| 5,626,062 | 5/1997 | Colvin . | |

*Primary Examiner*—James G. Smith
*Attorney, Agent, or Firm*—Charles E Baxley, Esq.

[57] ABSTRACT

A ratchet wrench includes a head having a slot for receiving a pawl. A driving member and an actuator are rotatably engaged in the head. A spring is engaged in the actuator and includes an arm engaged in an oblong hole of the pawl for allowing the actuator to rotate and to move the pawl to either of the narrower ends of the slot. The driving member may be rotated by the head in one direction when the pawl is engaged in one of the narrower ends of the slot and may be rotated in a reverse direction when the pawl is engaged in the other narrower end.

4 Claims, 5 Drawing Sheets

CONTROL MECHANISM FOR RATCHET WRENCH

BACKGROUND OF THE INVENTION

1. Field of the Invention

The present invention relates to a wrench, and more particularly to a control mechanism for a ratchet wrench.

2. Description of the Prior Art

Typical ratchet wrenches comprise a driving member rotatably engaged in the head and including a number of teeth formed in the outer peripheral portion, a pawl pivotally secured in the head at a pivot shaft, and a knob for rotating the pawl and for allowing the pawl to control the rotational direction of the driving member. One of the typical ratchet wrenches is disclosed in U.S. Pat. No. 5,626,062 to Colvin. However, for such a typical ratchet wrench, the pawl may not be easily rotated, and the user have to spend a great energy for rotating the pawl.

The present invention has arisen to mitigate and/or obviate the afore-described disadvantages of the conventional ratchet wrenches.

SUMMARY OF THE INVENTION

The primary objective of the present invention is to provide a ratchet wrench including a pawl that may be easily operated and moved so as to select the driving direction of the driving member.

In accordance with one aspect of the invention, there is provided a ratchet wrench comprising a head including a slot having two narrower ends, a driving member rotatably engaged in the head and including an engaging bore and including an outer peripheral surface having a plurality of teeth, an actuator rotatably engaged in the head and including an opening, a pawl slidably engaged in the slot of the head and adapted to be moved to either of the narrower ends of the slot, the pawl including at least one tooth for engaging with the teeth of the driving member, the pawl including a hole, and a spring engaged in the opening of the actuator and including an arm engaged in the hole of the pawl for allowing the actuator to rotate and to move the pawl to either of the narrower ends of the slot. The driving member is allowed to be rotated by the head in a first direction when the pawl is engaged in a first of the narrower ends of the slot, and the driving member is allowed to be rotated by the head in a reverse direction when the pawl is engaged in a second of the narrower ends of the slot. The spring does not apply a spring force directly against the pawl for forcing and pressing the teeth of the pawl to engage with that of the driving member. The spring only applies a small portion of the force against the pawl for forcing the pawl against the driving member such that the teeth of the pawl may be easily disengaged from the teeth of the driving member for allowing the pawl to be easily moved relative to the driving member by the action of the spring and the actuator.

The actuator includes a groove, the spring includes an extension engaged in and retained in place by the groove, the arm is extended from the extension. The ratchet wrench includes a longitudinal axis, the hole of the pawl extends perpendicular to the longitudinal axis of the ratchet wrench for engaging with the arm of the spring. The hole of the pawl is an oblong hole for loosely engaging with the arm of the spring.

The engaging bore of the driving member includes a hexagonal cross section and includes an inner peripheral surface having an annular groove, the ratchet wrench further includes a spring engaged in the annular groove of the driving member for engaging with and for retaining a fastener in place.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

A similar ratchet wrench was disclosed in a co-pending U.S. patent application filed on Jul. 16, 1997, entitled "CONTROL MECHANISM FOR RATCHET WRENCH", the serial number has not be assigned. The co-pending U.S. patent application is taken as a reference for the present invention.

Figure 1:
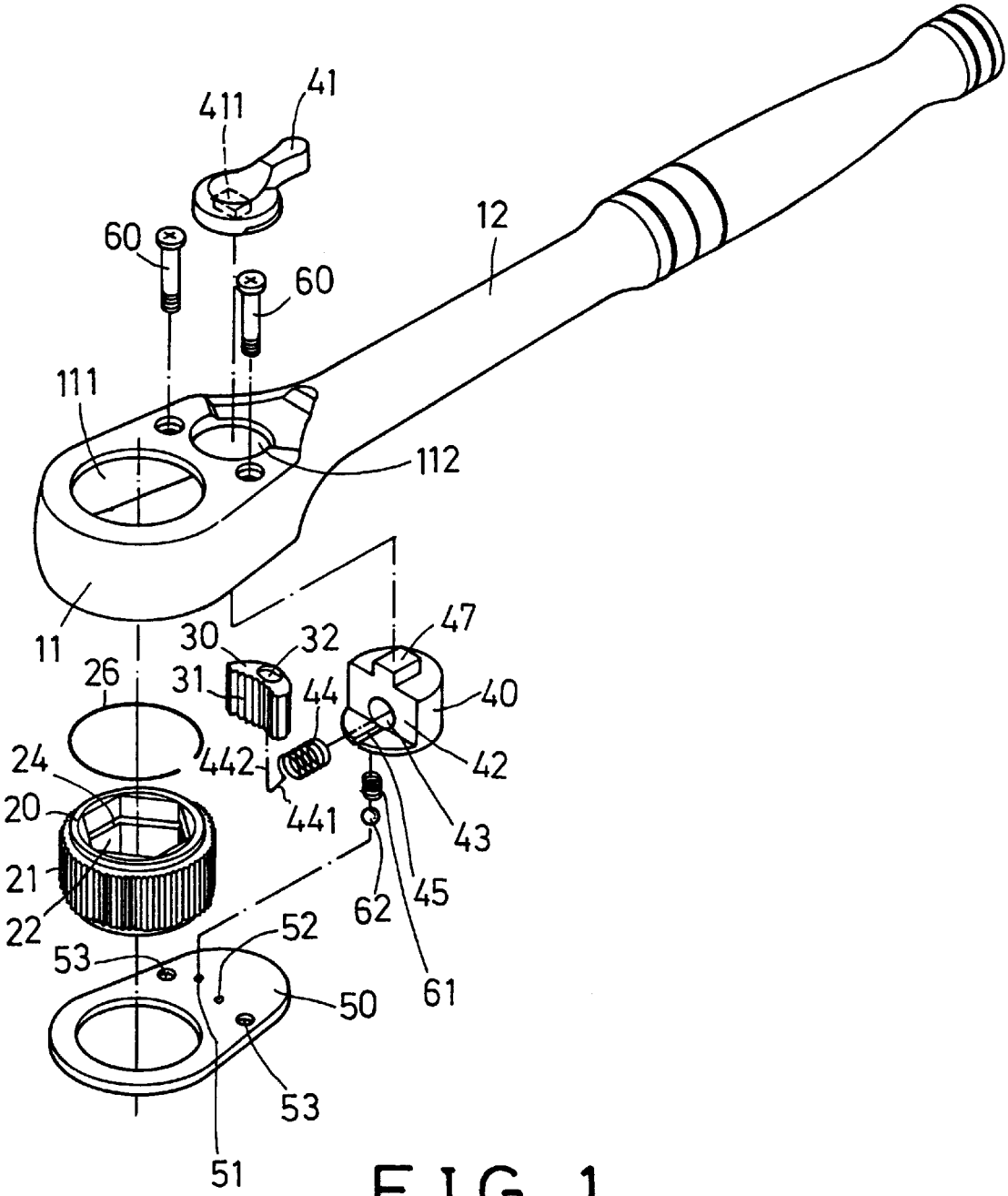
FIG. 1 is an exploded view of a ratchet wrench in accordance with the present invention.
Figure 2:
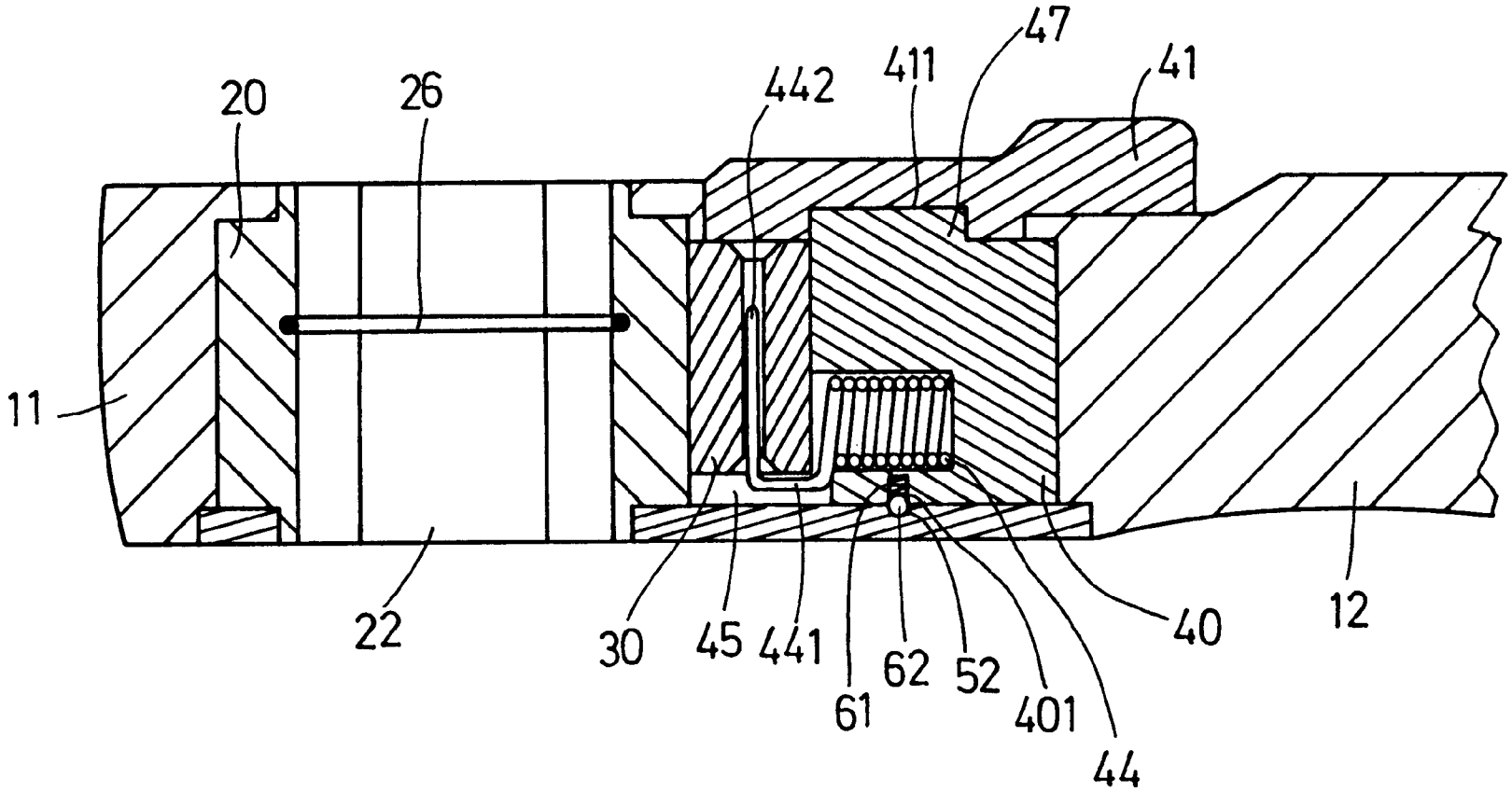
FIG. 2 is a cross sectional view of the ratchet wrench.
Figure 3:
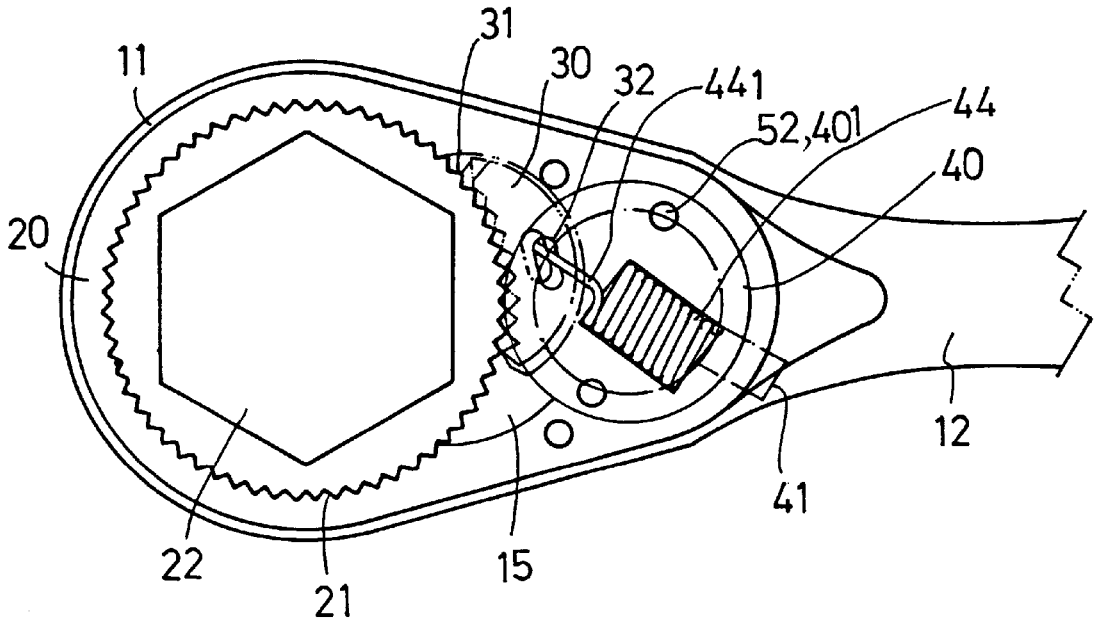
FIG. 3 is a bottom view of the ratchet wrench.

Referring to the drawings, and initially to FIGS. 1–3, a ratchet wrench in accordance with the present invention comprises a head 11 formed on one end of a handle 12 and having two orifices 111, 112. A driving member 20 is rotatably engaged in the head 11 and aligned with the orifice 111 and includes a number of teeth 21 formed in the outer peripheral surface. The driving member 20 includes a engaging bore 22 having a hexagonal cross section for engaging with an extension (FIGS. 4 and 5) or a fastener (FIG. 6). An annular groove 24 is formed in the inner peripheral portion of the driving member 20 for engaging with a spring 26 which is provided for engaging with and for retaining the extension or socket 80 (FIGS. 4 and 5) or the fastener (FIG. 6) in place.

An actuator 40 is rotatably engaged in the head 11 and aligned with the orifice 112 and includes a cut off portion 42 and includes an opening 43 for engaging with a spring 44 which includes an outward extended extension 441 and which includes an arm 442 extended upward from the extension 441. The actuator 40 includes a groove 45 for engaging with and for retaining the extension 441 of the spring 41 in place. The head 11 includes a slot 15 (FIG. 4) having two narrower ends and having a wider middle portion. A pawl 30 is engaged in the slot 15 of the head 11 for engaging with either of the narrower ends of the slot 15. The pawl 30 includes two or more teeth 31 for engaging with the teeth 21 of the driving member 20 and includes an oblong hole 32 for engaging with the arm 442 of the spring 44 and for allowing the arm 442 to be loosely engaged in the oblong hole 32. The oblong hole 32 extends substantially peripendicular to the longitudinal axis of the handle 12 and substantially parallel to the upward extending arm 442 of the spring 44 for loosely engaging with the arm 442. A cover plate 50 is secured to the bottom of the head 11 by fastening screws 60 which are threadedly engaged with the screw holes 53 of the cover plate 50. The cover plate 50 may secure the driving member 20 and the pawl 30 and the actuator 40 in place. The actuator 40 includes a cavity 401 (FIG. 2) formed in the bottom for engaging with a spring 61 and a projection ball 62 which may be biased to engage with either of two depressions 51, 52 of the cover plate 50 for positioning the actuator 40 to the cover plate 50 and to the head 11. The actuator 40 includes a projection 47 extended upward for engaging with a recess 411 of a knob 41 which may be used for rotating the actuator 40 and thus for moving the pawl 30 to either of the two narrower ends of the slot 15.

In operation, as shown in FIG. 3, when the pawl 30 is moved to one of the narrower ends of the slot 15 and when the handle 12 is rotated clockwise by a user, the driving member 20 may be rotated clockwise by the handle 12 and by the engagement between the pawl 30 and the driving member 20. However, the driving member 20 may not be rotated counterclockwise by the pawl 30 and by the handle 12 when the handle 12 is rotated counterclockwise at this moment. When the pawl 30 is moved to the other narrower end of the slot 15 and when the handle 12 is rotated counterclockwise, the driving member 20 may be rotated counterclockwise by the handle 12. However, the driving member 20 may not be rotated clockwise by the pawl 30 when the handle 12 is rotated clockwise at this moment.

It is to be noted that the spring 44 includes an extension 441 engaged in the groove 45 of the actuator 40 and includes an arm 442 engaged in the oblong hole 32 of the pawl 30 such that the spring 44 does not apply a spring force directly against the pawl 30 for forcing and pressing the teeth 31 of the pawl 30 to engage with that of the driving member 20. The spring 44 only applies a small portion of the force against the pawl 30 for forcing the pawl 30 against the driving member 20 such that the teeth 31 of the pawl 30 may be easily disengaged from the teeth 21 of the driving member 20 for allowing the pawl 30 to be easily moved relative to the driving member 20 by the action of the spring 44 and the actuator 40. The arm 442 of the spring 44 may be used for retaining the pawl 30 in either of the narrower ends of the slot 15 and does not apply a great force to force the pawl 30 against the driving member 20. The pawl 30 may be solidly engaged in either of the narrower ends of the slot 15 by the handle 12 and the driving member 20.

Figure 4:
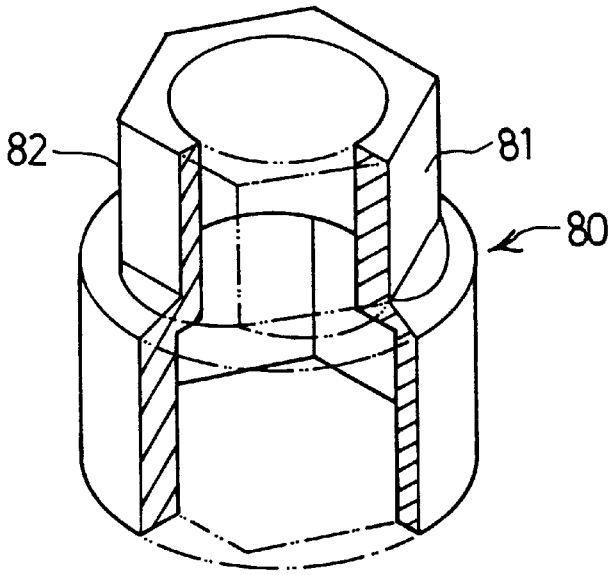
FIG. 4 is a perspective view of a socket to be engaged with the ratchet wrench as shown in FIGS. 1–3.
Figure 5:
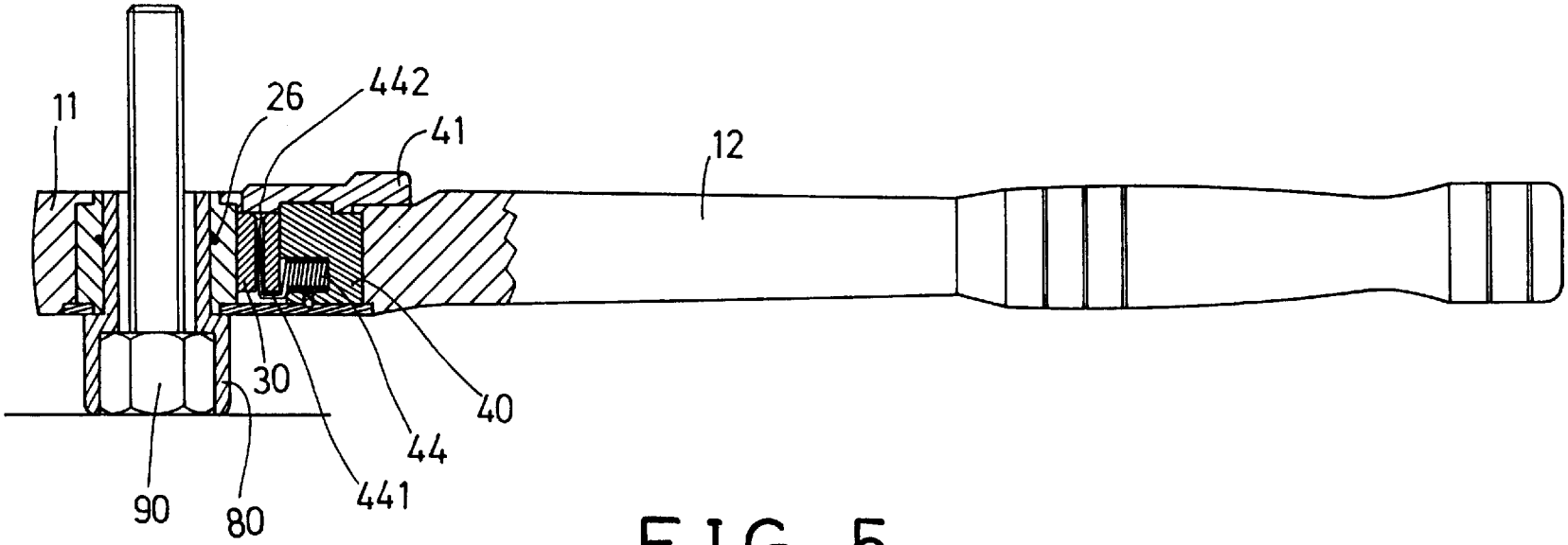
FIGS. 5 and 6 are side views illustrating the operation of the ratchet wrench, in which a portion of the head is cut off for showing the engagement of the ratchet wrench with a fastener.
Figure 6:
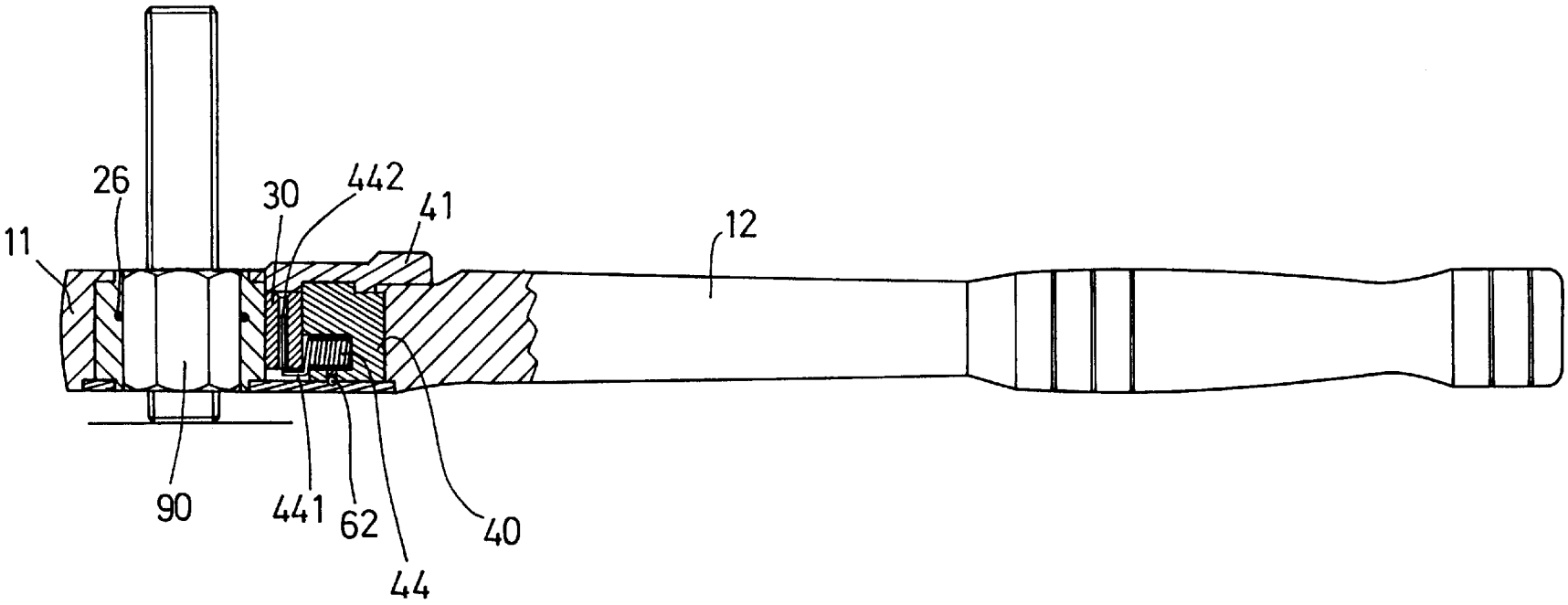

Referring next to FIGS. 4 and 5, the hexagonal bore 22 of the driving member 20 may be used for engaging with a hexagonal stud 81 of a socket 30 and for driving the socket 80 to actuate a fastener 90. The stud 81 includes six notches 82 formed in the six cusps of the outer peripheral portion of the stud 81 for engaging with the spring 26 and for allowing the spring 26 to solidly and stably retain the socket 80 in place. As shown in FIG. 6, the driving member 20 may also be used for directly engaging with and for driving the fastener 90.

Accordingly, the ratchet wrench in accordance with the present invention includes a pawl that may be easily operated and moved so as to select and determine the driving direction of the driving member.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet wrench comprising:

a head including a slot having two narrower ends, a driving member rotatably engaged in said head and including an engaging bore and including an outer peripheral surface having a plurality of teeth, an actuator rotatably engaged in said head and including an opening, a pawl slidably engaged in said slot of said head and adapted to be moved to either of said narrower ends of said slot, said pawl including at least one tooth for engaging with said teeth of said driving member, said pawl including a hole, and a spring engaged in said opening of said actuator and including an arm engaged in said hole of said pawl for allowing said actuator to rotate and to move said pawl to either of said narrower ends of said slot, said driving member being allowed to be rotated by said head in a first direction when said pawl is engaged in a first of said narrower ends of said slot, and said driving member being allowed to be rotated by said head in a reverse direction when said pawl is engaged in a second of said narrower ends of said slot, said actuator including a groove, said spring including an extension engaged in and retained in place by said groove, said arm being extended from said extension.

2. A ratchet wrench according to claim 1, wherein said ratchet wrench includes a longitudinal axis, said hole of said pawl extends perpendicular to said longitudinal axis of said ratchet wrench for engaging with said arm of said spring.

3. A ratchet wrench according to claim 1, wherein hole of said pawl is an oblong hole for loosely engaging with said arm of said spring.

4. A ratchet wrench according to claim 1, wherein said engaging bore of said driving member includes a hexagonal cross section and includes an inner peripheral surface having an annular groove, said ratchet wrench further includes a spring engaged in said annular groove of said driving member for engaging with and for retaining a fastener in place.

* * * * *